United States Patent [19]

Holl

[11] Patent Number: 4,593,754

[45] Date of Patent: Jun. 10, 1986

[54] SHELL AND TUBE HEAT TRANSFER APPARATUS AND PROCESS THEREFOR

[76] Inventor: Richard A. Holl, 25672 Taladro Cir. B,, Mission Viejo, Calif. 92691

[21] Appl. No.: 767,254

[22] Filed: Aug. 21, 1985

Related U.S. Application Data

[63] Continuation of Ser. No. 686,630, Dec. 31, 1984, abandoned, which is a continuation of Ser. No. 539,198, Oct. 5, 1983, abandoned, which is a continuation-in-part of Ser. No. 282,467, Jul. 13, 1981, abandoned, which is a continuation-in-part of Ser. No. 162,414, May 24, 1980, abandoned.

[51] Int. Cl.[4] ..... F28F 9/24; F28F 13/02; F28F 13/08

[52] U.S. Cl. ..... 165/109.1; 165/161; 165/174; 165/179; 165/907

[58] Field of Search ..... 165/109.1, 160, 161, 165/164, 165, 174, 179, 185, 907

[56] References Cited

U.S. PATENT DOCUMENTS

| | | | |
|---|---|---|---|
| 1,015,261 | 1/1912 | Bone et al. | 122/367 PF |
| 3,063,925 | 11/1962 | Huet | 165/109 T |
| 3,170,512 | 2/1965 | Smith | 165/DIG. 10 |
| 3,704,748 | 12/1972 | Hapgood | 165/179 X |
| 3,921,711 | 11/1975 | Westbrock | 165/174 X |
| 3,921,712 | 11/1975 | Renzi | 165/165 |
| 4,051,891 | 10/1977 | Harrison | 165/DIG. 10 |

FOREIGN PATENT DOCUMENTS

| | | | |
|---|---|---|---|
| 535531 | 4/1922 | France | 122/367 PF |
| 531112 | 12/1940 | United Kingdom | 165/DIG. 10 |

*Primary Examiner*—Sheldon J. Richter
*Attorney, Agent, or Firm*—Hirons, Rogers & Scott

[57] ABSTRACT

Shell and tube heat transfer apparatus and a corresponding process of heat transfer employ a fluid flow consisting of non-turbulent boundary-layers adjacent the inner and outer heat exchanger surfaces of the tubes and a non-turbulent core-layer between the boundary-layers and interfacing therewith. Interrupter-structures disposed within the tube and shell flow passes and interrupt the full development of the boundary-layers at a multitude of spaced spots, leaving the heat transfer surfaces unaltered, unmodified and uninterrupted, so that the boundary-layers cannot increase in thickness but will partially separate from the surfaces and mix non-turbulently with the core-layer to effect the required heat transfer between the surfaces and the fluid. The interrupter-structure preferably consists of a plurality of rows of spheres, with which the space remote from the heat exchange surface is filled with a space-filling material to prevent the useless flow of fluid in a space not effective for heat transfer. The interrupter structure may also comprise a unitary body of equivalent shape.

12 Claims, 14 Drawing Figures

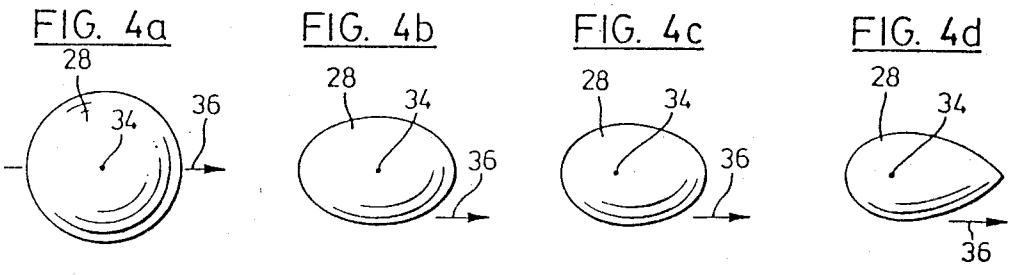
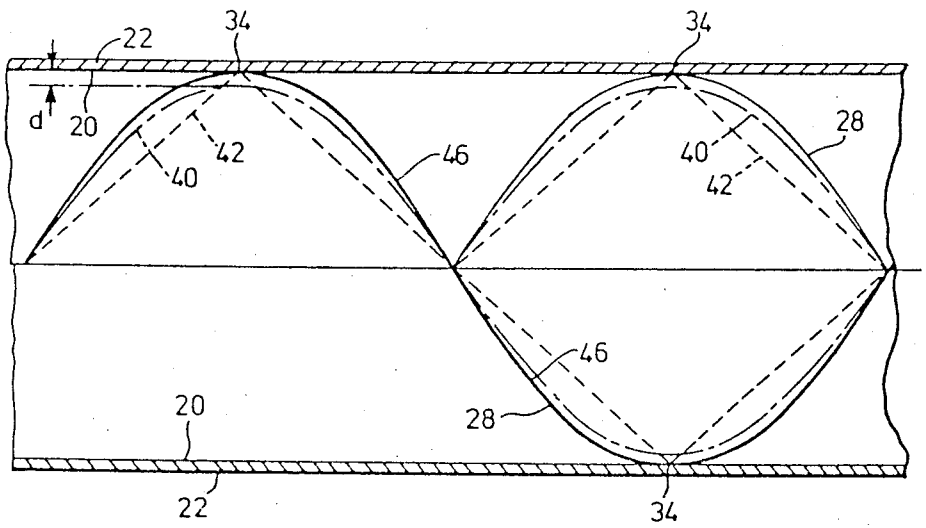
FIG. 5

SHELL AND TUBE HEAT TRANSFER APPARATUS AND PROCESS THEREFOR

This application is a continuation of my earlier application Ser. No. 06/686,630 filed Dec. 31, 1984, now abandoned, which is a continuation of my earlier application Ser. No. 06/539,198 filed Oct. 5, 1983, now abandoned, which is a continuation-in-part of my earlier application Ser. No. 06/282,467 filed July 13, 1981, now abandoned, which is a continuation-in-part of my earlier application Ser. No. 06/162,414 filed May 24, 1980, also now abandoned.

FIELD OF THE INVENTION

This invention is concerned with new shell and tube apparatus for heat transfer and with a new process for heat transfer, as employed in such apparatus.

REVIEW OF THE PRIOR ART

It is a constant endeavour in the field of heat transfer to improve the efficiency of heat transfer processes in order to improve the efficiency and also if possible lower the cost of the apparatus employing the improved process. To this end a number of prior proposals have been made among which are:

(a) reducing the thickness of the boundary-layers of the fluid flowing in a passage by the promotion of turbulence in the fluid flow, for example by roughening the flow passage walls and/or the provision of turbulence promoters in the passage.

(b) the induction of boundary-layer separation from the heat transfer surfaces by use of curved or wavy heat transfer surfaces and (c) the interruption of the heat transfer surfaces, as with the so-called "split-fin" apparatus.

A frequent serious problem with such proposals is that, although the promotion of turbulence or the interruption of the heat transfer surfaces in laminar flow do increase the heat transfer per unit area, they also cause a disproportionate increase in the pumping power per unit area required to maintain the fluid flow at the required rate, because of the increased turbulence and inefficient laminar flow diffusion mixing, and a consequent considerable increase in manufacturing cost, with the result that the overall economy of the system is reduced. In commercial practice therefore the undesirable results prevent the adoption of such proposals in many cases unless there is an overriding need, for example, for compactness in size.

As an example of proposal (a) British Patent Ser. No. 1,172,247 issued to Hugh Eddowes and Peter Ernest Goss discloses a heat exchange apparatus in which a flow passage formed between parallel plates is provided with a structure consisting of crossed rods or woven wire mesh in order to promote turbulence in the flow. U.S. Pat. No. 1,862,219 issued to J. M. Harrison discloses another structure in which expanded metal is used as a fluid deflector to thin out the boundary-layer. A large number of other so-called "turbulence promoters" have been proposed hitherto for this purpose.

As an example of proposal (b) the publication "Heat Transfer Handbook" by A. P. V. Company Inc. of Tonawanda, N.Y., provides pumping power vs. heat transfer data and describes the way in which an improvement can be achieved in heat transfer by induction of turbulent fluid flow even at low Reynolds numbers, this induction being produced by use of curved or wavy heat transfer plates which are stacked together with interposed gaskets to constitute the so-called "plate and frame" exchangers. Other examples are described at pages 216 and 217 in the publication by W. M. Kays and A. L. London "Compact Heat Exchangers" 2nd edition, McGraw Hill Series in Mechanical Engineering, N.Y., 1964.

As an example of proposal (c) U.S. Pat. Ser. No. 2,360,123 issued to George W. Gerstung and Hiram Walker discloses a heat transfer apparatus employing split corrugated fins, as does also the above-mentioned "Compact Heat Exchangers" at page 212. With this arrangement very high coefficients of heat transfer are obtained while the flow is laminar by keeping the fin length very short through slitting and off-setting. This allows the maximization of heat transfer within the developing boundary layers, since these are very thin and close to the leading edges of the split fins, the splitting and offsetting preventing development of thick boundary layers. The mixing with the core-layers occurs mainly by conduction through the fluid and therefore extremely small hydraulic radii are necessary for acceptable mixing efficiencies. Quite frequently slight burrs develop when the fins are cut, making the flow turbulent at quite low Reynolds numbers with an associated higher friction drag. The results in both cases are high pumping power requirements per unit of heat transfer surface and very high cost of manufacture.

DEFINITION OF THE INVENTION

It is therefore an object of the invention to provide a new process for heat transfer by which the heat transfer can be increased without a corresponding disproportionate increase in pumping power.

It is also an object of the invention to provide shell and tube heat transfer apparatus of a new type in which the heat transfer can be increased without a corresponding disproportionate increase in pumping power.

More specific objects are to provide new shell and tube heat transfer apparatus and processes in which the heat transfer is increased with avoidance of turbulence in the presence of laminar wake-interference flow.

In accordance with the present invention there is provided shell and tube heat exchange apparatus for heat exchange between two fluids comprising:

a shell having an inner wall, an inlet to the interior thereof and an outlet therefrom for the passage of a respective fluid through the shell space in the shell interior;

at least one tube mounted within the shell having an inner and an outer surface and having an inlet to the interior thereof and an outlet therefrom for the passage through the tube interior of a respective fluid, each tube wall constituting a heat exchange wall between the two fluids in the shell interior and the tube interior;

fluid flow within the tube interior taking the form of a non-turbulent boundary layer immediately adjacent to the tube inner surface, and a core-layer interfacing with the boundary-layer;

a tube-side fluid flow interrupter structure within each tube comprising a plurality of longitudinally extending rows of spheroidal members contacting the inner wall of the passage, the structure interrupting non-turbulently the full development of at least the boundary-layer at the tube inner surface at a plurality of spaced interruption spots, whereby parts of the interrupted boundary-layer will separate non-turbulently from the tube inner surface between the interruption spots and mix with the core-layer to effect heat transfer between the tube inner surface, its respective boundary-layer, and the core-layer; and the space between the longitudinally extending rows being filled with a space-filling material to prevent useless flow of fluid in the part of the tube interior remote from the tube inner surface.

Also in accordance with the invention there is provided shell and tube heat exchange apparatus for heat exchange between two fluids comprising:

a shell having an inner wall, an inlet to the interior thereof and an outlet therefrom for the passage of a respective fluid through the shell space in the shell interior;

at least one tube mounted within the shell having an inner and an outer surface and having an inlet to the interior thereof and an outlet therefrom for the passage through the tube interior of a respective fluid, each tube wall constituting a heat exchange wall between the two fluids in the shell interior and the tube interior;

fluid flow within the shell space taking the form of a non-turbulent boundary layer immediately adjacent to the tube outer surface, and a core-layer interfacing with the boundary-layer;

a shell-side fluid flow interrupter structure within the shell space comprising a plurality of spheroidal members surrounding and contacting the tube outer wall, the structure interrupting non-turbulently the full development of at least the boundary-layer at the tube outer surface at a plurality of spaced interrruption spots, whereby parts of the interrupted boundary-layer will separate non-turbulently from the tube outer surface between the interruption spots and mix with the core layer to effect heat transfer between the tube outer surface, its respective boundary-layer, and the core-layer; and the space between the shell-side interrupter structure spherical members and the shell inner wall being filled with a space-filling material to prevent useless flow of fluid in a part of the shell interior space remote from the tube outer surface.

DESCRIPTION OF THE DRAWINGS

Apparatus and processes which are particularly preferred embodiments of the invention will now be described, by way of example, with reference to the accompanying diagrammatic drawings wherein.

Figure 6:
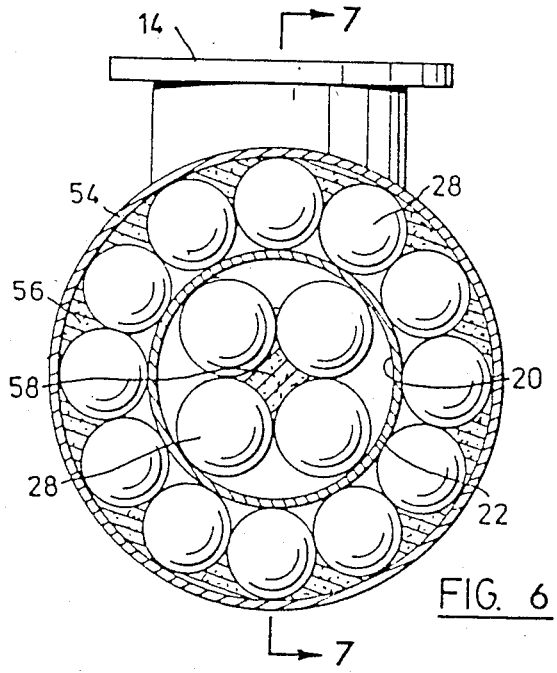
Figure 7:
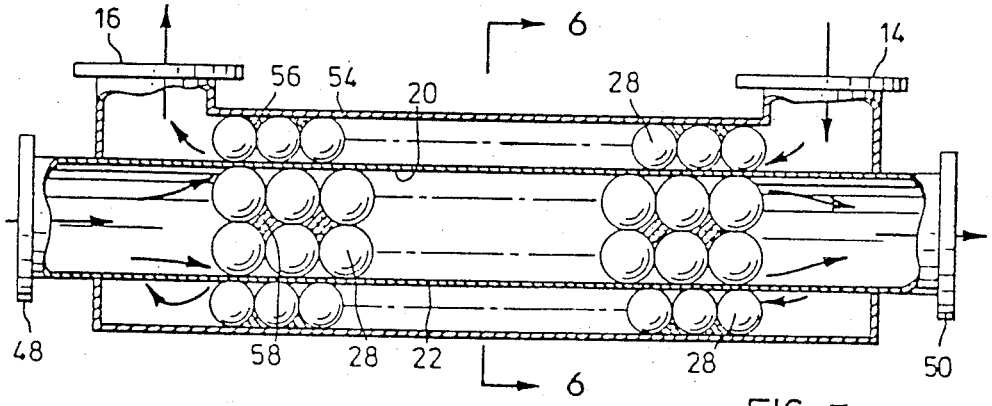
Figure 8:
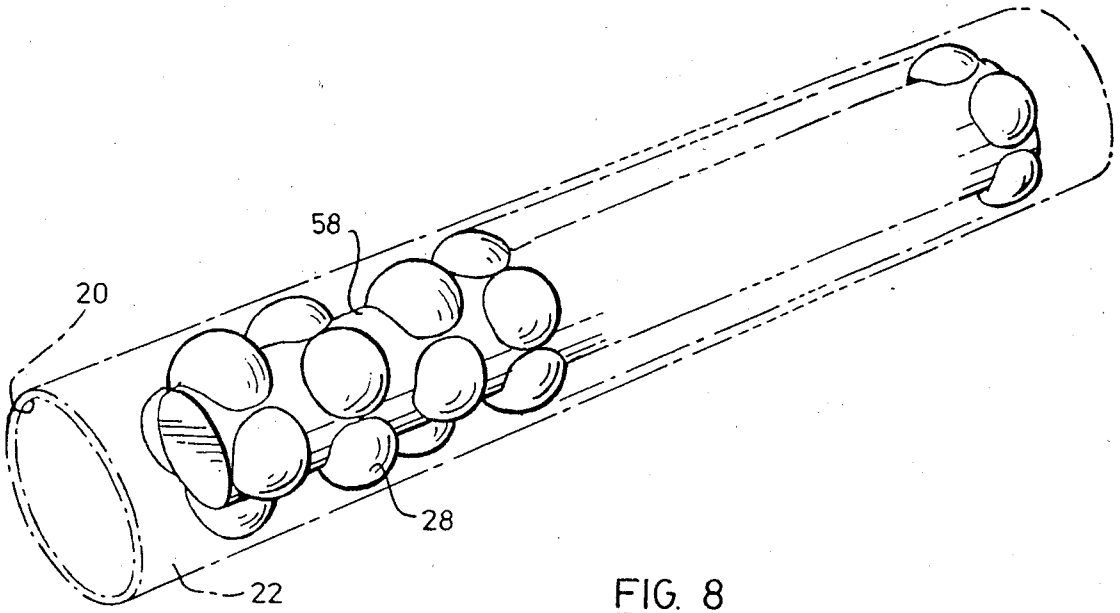
Figure 9:
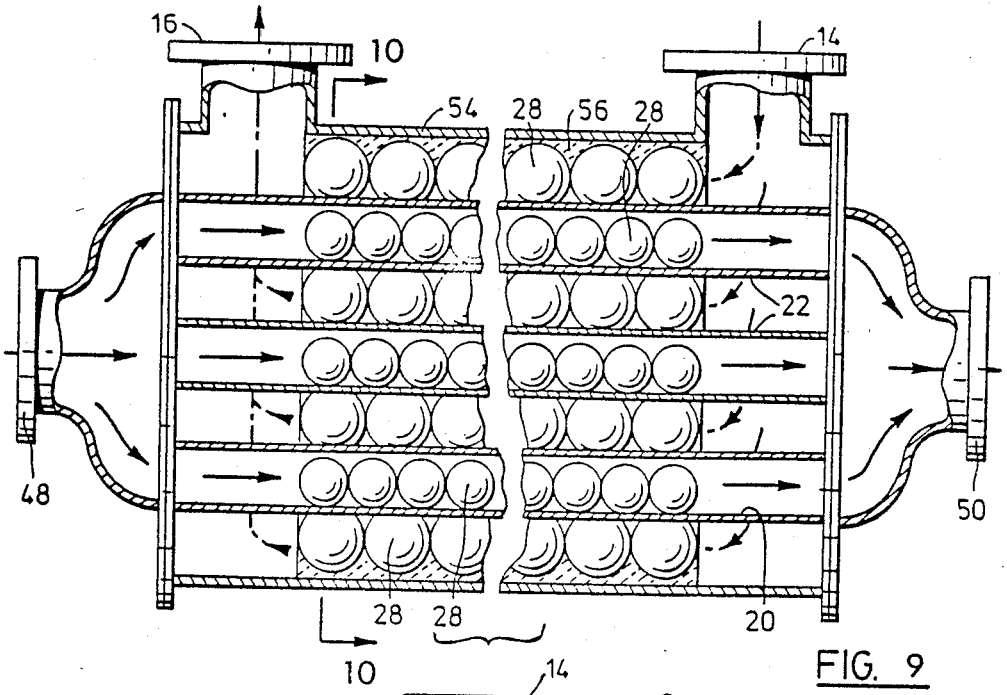
Figure 10:
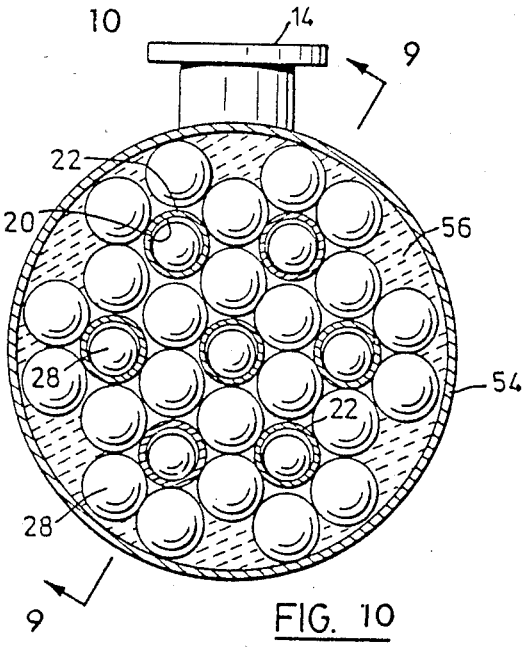
Figure 11:
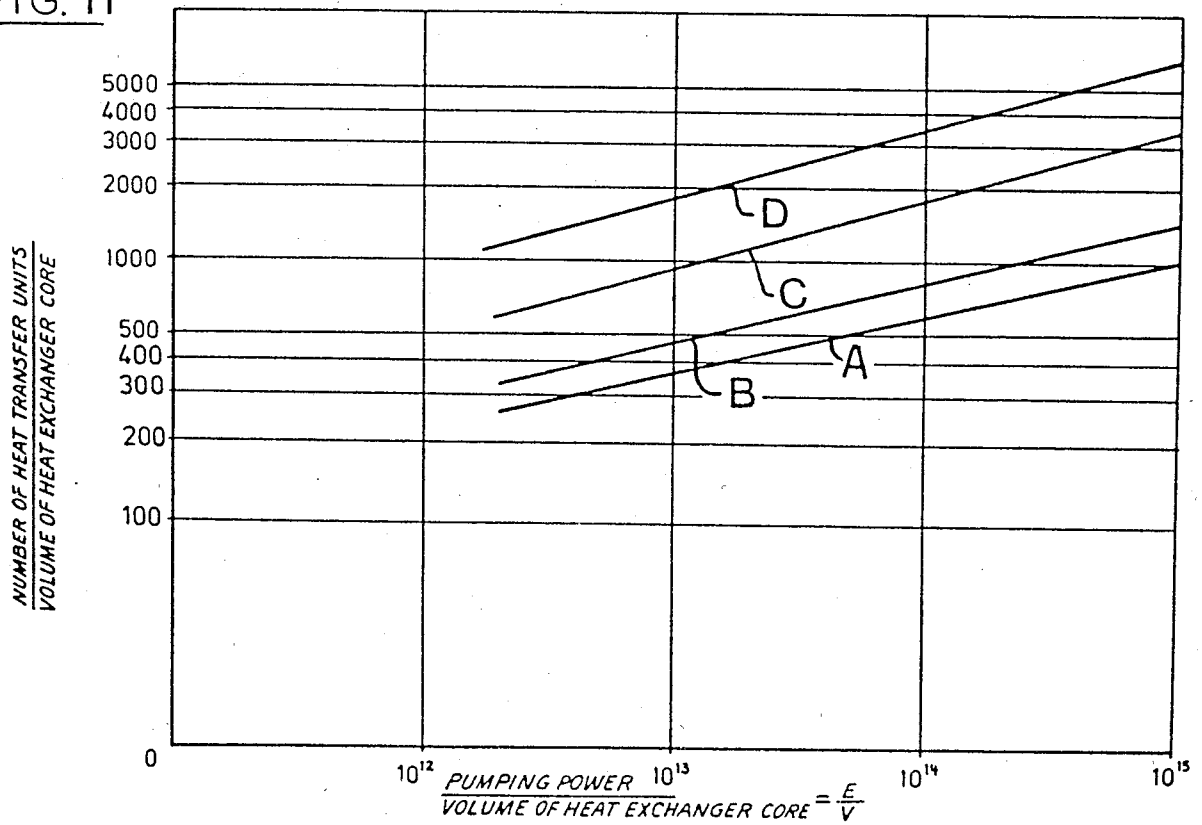

FIGS. *4a*, *4b*, *4c* and *4d* are plan views of a small portion of different interruption structures to show the respective forms that can be taken thereby;

FIG. 5 is a schematic cross-section to illustrate the preferred form of the interrupter structure:

FIG. 6 is a transverse cross-section through a single tube-in-shell heat exchanger of the invention;

FIG. 7 is a longitudinal cross-section on the line 7—7 of FIG. 6;

FIG. 8 is a perspective view of a unitary form of interrupter structure for use in the interior of a heat exchanger tube;

FIG. 9 is a longitudinal cross-section on the line 9—9 of FIG. 10 through a multiple tube shell-and-tube heat exchanger of the invention in which the tubes are of circular cross-section;

FIG. 10 is a transverse cross-section on the line 10—10 of FIG. 9; and FIG. 11 is a graph to show the relative performance ranking of heat exchanger surfaces of the invention as compared with surfaces from prior art tubulus and plate heat exchangers.

DESCRIPTION OF THE PREFERRED EMBODIMENTS

Figure 1:
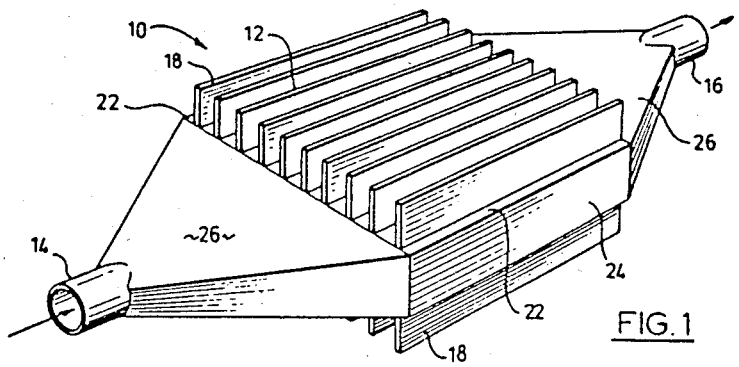
FIG. 1 is a perspective view of a heat transfer apparatus, wherein the heat transfer is from a fluid flowing within the apparatus to the ambient atmosphere surrounding the apparatus.

The simple convection-type heat transfer apparatus 10 of FIG. 1 is intended for the transfer of heat carried by a liquid fluid, such as oil or water, to the gaseous ambient atmosphere; such apparatus is commonly used for example as an oil or water cooler. The apparatus consists of a hollow body 12 providing a parallel-walled flow passage containing a fluid flow interrupter structure to be described below. The liquid fluid is fed into the apparatus via an inlet pipe 14 and discharged therefrom via an outlet pipe 16. The exterior of the body may be provided in known manner with spaced parallel fins 18 for more efficient heat transfer to the ambient air.

The interior of the body 12 provides a non-turbulent fluid flow passage comprising two spaced parallel facing heat-transferring wall surfaces 20 (FIG. 3) provided by the walls 22, between which wall surfaces the liquid fluid flows. The passage is completed by two side walls 24 and the enclosure is completed by two transition pieces 26 which progressively change the circular cross-section of the pipes 14 and 16 to the rectangular cross-section of the flow passage. In this embodiment a fluid flow interrupter structure disposed within the passage consists of a plurality of densely packed spheres 28 of a material that will be unaffected by the fluid, such as metal, glass or porcelain, the packing being such that the spheres contact one another. The diameter of the spheres is such that they are each in point contact with the opposed heat transferring wall surfaces 20. Since in this embodiment the spheres are touching one another they may be joined to each other at their points of mutual contact to form a unitary structure. In other embodiments they may be packed at a lower density at which they are spaced from one another, for example, by an interposed apertured plate having the spheres disposed in the apertures thereof. Other variations will be described below.

It is known to those skilled in the art that fluid flowing within a passage has boundary-layers 30 immediately adjacent the surfaces 20, which act to insulate the wall surfaces from the main body of the fluid flowing in a core layer 32 between and interfacing with the boundary layers 30, and which therefore reduce the heat transfer between the surfaces 20 and the core layer 32. Corresponding boundary layers 30 are also present on the surfaces of the spheres 28. It is also known that an unobstructed boundary layer increases progressively in thickness in the direction of fluid flow, which will increase its insulating effect. As described above, proposals have been made hitherto to disrupt the boundary layers by roughening or ridging the surface over which they flow, but such proposals have the effect of also increasing to a disproportionately greater extent the pumping power required.

In apparatus of the invention the boundary layers 30 are interrupted in a "spot-wise" manner at spaced spots 34 by means of the fluid flow interrupter structure interposed between the heat transfer surfaces, while maintaining a non-turbulent fluid flow in the core 32. In the apparatus of the invention not only are the heat transfer surfaces 20 not roughened, etc., but on the contrary they are made as smooth as is economically possible, to the extent that in many embodiments the surfaces 20 will be polished to the desired degree of smoothness. The disruption of the boundary layers 30 at the multitude of spaced spots 34 ensures that they stay thin, while the manner of their disruption ensures that turbulence is avoided that would cause unduly high friction drag. The polishing of all surfaces including those of the spheres also assists in the desired minimizing of the friction drag.

Thus, the invention may be regarded as comprising a fluid flow system for improving the ratio of convective heat transfer to friction power per unit heat transfer surface area by providing specially shaped interrupting and mixing-structures of low friction drag immediately adjacent a smooth heat transfer surface using hydraulic radii that guarantee total laminar flow. The mixing structures contain cellular voids, which are connected with one another, in each of which the fluid rotates spiral-like as a single laminar eddy. These eddies are very efficient means of mixing laminar streams, and preferably are obtained by coinciding a wake eddy downstream of an interruption point with an advance eddy upstream of a subsequent interruption point so as to produce wake-interference flow, which provides the highest efficiency. The boundary layers 30 on the curved surfaces of the mixing-structures are fairly thick, whereas the boundary layers of the heat transfer surfaces, situated opposite the mixing-structure surfaces, remain very thin on average because they are reduced regularly and spotwise at the large number of contact points between the surface of the mixing-structure and the heat transfer surface, and are in addition exposed to the highest local velocities which occur predominantly very close to the flat heat transfer surface. This allows rapid heat flow through the heat transfer surface.

It is also believed that efficiency is improved because the velocity gradients adjacent to the heat transfer surfaces are much larger than over the curved surfaces of the interrupting mixing structure. These velocity gradients are, moreover, maintained largely at the heat transfer surfaces by virtue of the regularly spaced flow interruptions occuring at the large number of contact points between the mixing structure and the heat transfer surface. These interruptions also cause the flow to swirl at high velocity toward the heat transfer surface. Since it is well known from numerous experiments and theoretical analysis (see, e.g. pp 422–423, Principles of Heat Transfer, 3rd edition by F. Kreith, Publishers Harper and Row, New York, 1976) that temperature gradients are proportional to velocity gradients, the interrupting mixing structure which produces repeated steep velocity gradients similar to so-called "entrance effects", also promotes increased heat transfer while the flow remains laminar.

The general direction of flow of the fluid is indicated by arrows 36, and the flow interrupter structure causes the production of laminar flow eddies 38 of shape and rotational frequency that depend upon the geometry of the structure. Wake-eddies will be produced around the spots of interruption downstream of the flow, while advance eddies will be produced upstream of the flow. If the spacing of the interruption spots 34 is made such that the advance- and wake-eddies of immediately successive spots coincide, then wake-interference flow is obtained whereby, in the absence of turbulent friction-drag, very efficient non-turbulent mixing is obtained between the interrupted boundary-layers 30 and the adjacent core layer 32. A turbulent flow, which is to be avoided, may be distinguished from an eddy in that the former is irregular and there is no observable pattern as with an eddy. Eddies and swirls therefore do not constitute turbulence. Again a laminar eddy or vortex is confined by solid boundaries or by laminar fluid flows, while a turbulent eddy or vortex will be surrounded by other eddies and vortices which interact with the turbulent eddy or vortex. The conditions for maintenance of laminar flow with a particular structure can be observed for example by providing suitable windows in an experimental structure and adding visible fluids to the fluid flow if required.

It is not necessary for the interposed structure to touch the passage walls as long as it is sufficiently close thereto to provide the necessary extent of interruption to the boundary layers. Thus, in the illustrated embodiment the portion of each spherical surface around the actual point of contact and submerged in the boundary layer will also be effective in this interrupting function. The interrupter structure may therefore be suspended within the enclosure and not actually touch the walls, or touch the walls at fewer points than there are interruption points.

Figure 2:
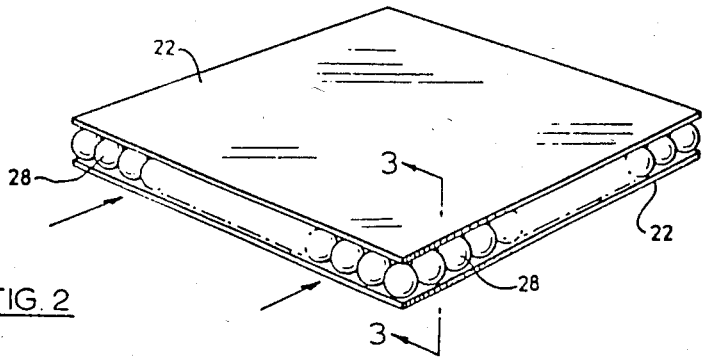
FIG. 2 is a similar view to FIG. 1, but with the fins, side and end walls removed to show one preferred form of fluid flow interrupter structure within its interios.
Figure 3:
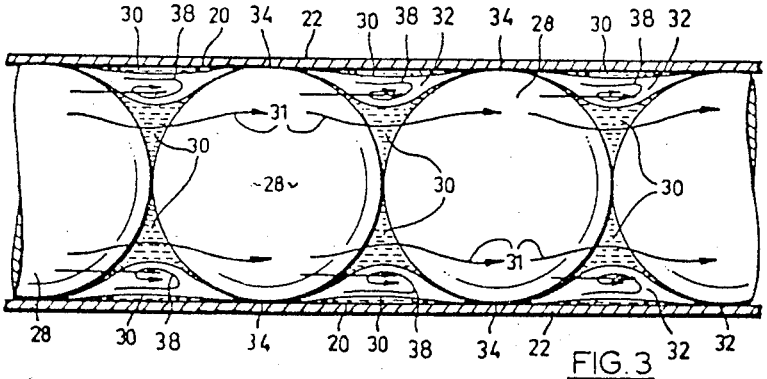
FIG. 3 is a section taken on the line 3—3 of FIG. 2 and showing the fluid flow obtained inside the apparatus.

FIG. 4*a* shows in plan view the profile of spherical interrupter structure elements of the structure of FIGS. 1 to 3, taken in the direction of flow of the fluid in the passage; the profile is of course a circle. Other profiles can be used and should be such as to present a smoothly contoured surface to the fluid flow, so as to reduce friction losses to a minimum and also to ensure the maintenance of laminar flow. FIG. 4*b* shows for example an ellipsoidal profile, while FIG. 4*c* shows an egg-shaped profile and FIG. 4*d* shows a drop-shaped profile; in the latter two profiles the face of largest radius faces upstream.

FIG. 5 illustrates the statement above that the elements of the interrupter structure do not necessarily contact the heat exchange surface and a chain-dotted profile 40 is illustrated in which this is not the case, the highest point of the profile being spaced a minimum distance d from the surface 20; in the case of a convex curvilinear surface spaced from a flat surface 20 this distance d should not be more than about 10% of the effective diameter of the curved surface.

A pyrimidal surface 42 is also illustrated in broken lines terminating at the contact point 34 and this is unsatisfactory for use in flow interrupting structures of the invention, principally because there is a drastically reduced opportunity for the establishment of high fluid flow velocities at the boundary layer, with consequent less disrupting of the layer and much less effective heat exchange at the surface; the preferred form of the profile may be characterised as being convex curvilinear and this is arranged to provide the maximum possible velocity as close as possible to the flat and smooth heat transfer surface while maintaining laminar flow.

Special situations arise for example when the fluid is very viscous, such as a viscous oil that is to be heated.

When the fluid is of high viscosity the spacing apart of the parallel walls 20 of the passage can be increased considerably without the establishment of turbulent flow, but such a fluid is usually of low thermal conductivity and a thermal boundary layer will be established immediately adjacent to the heat transfer surface that is much thinner than the respective boundary layer. The interposed structure must be arranged to interrupt this thinner thermal boundary-layer irrespective of the thickness of the boundary-layer. The principal factor in the determination of the thickness of the thermal boundary layer is the Prandtl number, which is high when the viscosity is high and the thermal conductivity is low.

One of the principal parameters to be considered in determining whether a particular fluid flow will be laminar and non-turbulent is the Reynolds number which is obtained by the relation:

$$R = \frac{\text{Fluid Mass Velocity} \times \text{Passage Equivalent Diameter}}{\text{Fluid Viscosity}}$$

Classically it was believed that with a Reynolds number less than about 4,000 the flow must be laminar, while if it was greater than about 6,000 it would become turbulent. It is not possible in the apparatus of the invention to determine the fluid velocities in the interrupter structure but only the overall velocity and the only proof that the flow will be laminar is to plot the so-called J-factor curve which will show an abrupt change in slope at the onset of turbulence. The existence of a J-factor curve of constant slope is therefore proof that laminar flow is occurring and this can occur with Reynolds numbers as high as 15,000.

The invention herein is applicable to heat exchangers of the shell and tube type, as illustrated by FIGS. 10 and 11 showing a single tube-in-shell exchanger in which one fluid path with inlet and outlet 14 and 16 respectigvely is formed by the annular space between an outer shell 54 and an inner circular cross-section tube 22, while the other fluid path with inlet 48 and outlet 50 is of course formed by the tube 22. The annular shell space is of radial dimension just sufficient to receive the spheres 28 and the spaces between the spheres and the inner wall of the outer shell are completely filled with a suitable cementitious material 56 to prevent fluid flow therethrough that would be wasted. The interrupter system employed within the tube 22 comprises rows of smaller spheres that are used to provide the necessary flow capacity with a sufficiently large number of interrupting points 34 both along the length of the tube and also around its circumference. As with the shell-side interrupter system the useless space between the rows is filled with a cementitious or other suitable material 58, such as concrete or ceramic cement.

As illustrated by the perspective view of FIG. 8, the separate spheres 28 and cement 58 in which they are embedded can constitute a unitary structure 60 formed for example by casting, so that the spheroidal members 28 protruding from the central matrix will engage the inner tube wall. Such a unitary structure may be more easily manufactured and more easily assembled into and disassembled from the apparatus. It will be noted that successive spheroidal members along the length of the structure are displaced circumferentially, giving the same effect as if the rows of spheroidal members had been disposed helically. Similarly, the cylinder of spheroidal members and the space-filling material 56 that are disposed against the shell inner wall can constitute a cylindrical unitary structure that is slid into position and removed as a unit.

FIGS. 12 and 13 illustrate a multiple tube in shell heat exchanger in which a plurality of parallel tubes 22 are disposed within a single outer shell 54. Each tube 22 is surrounded by spheres 28 in rows, circles or helixes thereof with some of the spheres contacting two adjacent tubes, so that it disrupts the boundary layers of both tubes. The tubes 22 thus take the place of the cement 58 of the struture of FIGS. 10 and 11 and only the cement 56 is required between the outermost spheres and the shell 54. The interrupter structure within the tubes 22 can be of the form illustrated by FIGS. 10 and 11.

The evaluation of the performance of heat exchanger surfaces is a difficult subject because of the large number of variables involved, but one method that has gained acceptance is described in the Transactions of the Society of Mechanical Engineers, Vol. 100, August 1978 in a paper by J. G. Soland, W. M. Mack, Jr. and W. M. Rohsenow entitled "Performance Ranking of Plate-Fin Heat Exchanger Surfaces". FIG. 11 is a plot of the ranking of surfaces in accordance with this method, comparing surfaces of the invention with a surface provided by a tube of 1.2 cm diameter and a plate heat exchanger of 0.5 cm plate pitch. Thus the vertical plot indicates the number of heat transfer units (NTU) per unit volume of the heat exchanger core (V), while the horizontal plot indicates the pumping power (E) required to move the fluid through the core per unit volume of the heat exchanger core (V). An improvement in heat exchanger performance is indicated by the line being higher on the vertical plot, and the increase in performance can be measured along any vertical line.

The test fluid was water and the lowest chain-dotted line A is for heat transfer in a tube of 1.2 cm diameter, using data obtained from the above-mentioned paper of Soland, Mack and Rohsenow. The broken line B is for a "APV" plate heat exchanger of 0.5 cm plate pitch, using data obtained from the "APV Heat Transfer Handbook, 2nd Edition, published by APV Inc. of Tonawanda, N.Y., U.S.A." It will be seen that line B represents an improvement of 28% in performance over line A. The lower solid line C plots the performance of a heat exchanger of the invention employing closely packed spheres of 6.35 mm diameter between plates of that spacing, while the higher solid line D plots the maximum performance so far obtained with a heat exchanger of the invention. It will be seen that line C represents an improvement of respectively 100% and 52% over lines A and B, while line D represents an improvement of respectively 415% and 290%.

What is claimed is:

1. Shell and tube heat exchange apparatus for heat exchange between two fluids comprising:

a shell having an inner wall, an inlet to the interior thereof and an outlet therefrom for the passage of a respective fluid through the shell space in the shell interior;

at least one tube mounted within the shell having an inner and an outer surface and having an inlet to the interior thereof and an outlet therefrom for the passage through the tube interior of a respective fluid, each tube wall constituting a heat exchange wall between the two fluids in the shell interior and the tube interior;

fluid flow within the tube interior taking the form of a non-turbulent boundary layer immediately adjacent to the tube inner surface, and a core-layer interfacing with the boundary-layer;

a tube-side fluid flow interrupter structure within each tube comprising a plurality of longitudinally extending rows of spheroidal members contacting the inner wall of the passage, the structure interrupting non-turbulently the full development of at least the boundary-layer at the tube inner surface at a plurality of spaced interruption spots, whereby parts of the interrupted boundary-layer will separate non-turbulently from the tube inner surface between the interruption spots and mix with the core layer to effect heat transfer between the tube inner surface, its respective boundary-layer, and the core-layer; and the space between the longitudinally extending rows being filled with a space-filling material to prevent useless flow of fluid in the part of the tube interior remote from the tube inner surface.

2. Shell and tube heat exchange apparatus as claimed in claim 1, wherein the spacing of immediately successive spaced interruption spots in the direction of flow is such that wake-interference flow is established between the said successive spots.

3. Shell and tube heat exchange apparatus as claimed in claim 1, wherein the tube-side fluid flow interruptor structure comprises a unitary body constituting the said plurality of longitudinally extending rows of spheroidal members protruding from the space-filling material.

4. Shell and tube heat exchange apparatus as claimed in claim 3, wherein the spheroidal elements are disposed in a helical configuration.

5. Shell and tube heat exchange apparatus for heat exchange between two fluids comprising:

a shell having an inner wall, an inlet to the interior thereof and an outlet therefrom for the passage of a respective fluid through the shell space in the shell interior;

at least one tube mounted within the shell having an inner and an outer surface and having an inlet to the interior thereof and an outlet therefrom for the passage through the tube interior of a respective fluid, each tube wall constituting a heat exchange wall between the two fluids in the shell interior and the tube interior;

fluid flow within the shell space taking the form of a non-turbulent boundary layer immediately adjacent to the tube outer surface, and a core-layer interfacing with the boundary-layer;

a shell-side fluid flow interrupter structure within the shell space comprising a plurality of spheroidal members surrounding and contacting the tube outer wall, the structure interrupting non-turbulently the full development of at least the boundary-layer at the tube outer surface at a plurality of spaced interruption spots, whereby parts of the interrupted boundary-layer will separate non-turbulently from the tube outer surface between the interruption spots and mix with the core layer to effect heat transfer between the tube outer surface, its respective boundary-layer, and the core-layer; and the space between the shell-side interrupter structure spherical members and the shell inner wall being filled with a space-filling material to prevent useless flow of fluid in a part of the shell interior space remote from the tube outer surface.

6. Shell and tube heat exchange apparatus as claimed in claim 5, wherein the spacing of immediately successive spaced interruption spots in the direction of flow is such that wake-interference flow is established between the said successive spots.

7. Shell and tube heat exchange apparatus as claimed in claim 5, and comprising a plurality of tubes mounted within the shell interior parallel to one another, wherein some of the spheres of the shell-side interrupting structure contact the outer surface of more than one tube.

8. Shell and tube heat exchange apparatus as claimed in claim 5, wherein the fluid flow within the tube interior also takes the form of a non-turbulent boundary layer immediately adjacent to the tube inner surface, and a core-layer interfacing with the boundary-layer;

the apparatus comprising a tube-side fluid flow interrupter structure within each tube comprising a plurality of longitudinally-extending rows of spheres contacting the inner wall of the passage, the structure interrupting non-turbulently the full development of at least the boundary-layer at the tube inner surface at a plurality of spaced interruption spots, whereby parts of the interrupted boundary-layer will separate non-turbulently from the tube inner surface between the said interruption spots and mix with the core layer to effect heat transfer between the tube inner surface, its respective boundary-layer, and the core-layer; and the space between the rows being filled with a space-filling material to prevent useless flow of fluid in a part of the tube interior space remote from the tube inner heat transfer surface.

9. Shell and tube heat exchange apparatus as claimed in claim 8, wherein the spacing of immediately successive spaced interruption spots in the direction of flow is such that wake-interference flow is established between the said successive spots.

10. Shell and tube heat exchange apparatus as claimed in claim 8, and comprising a plurality of tubes mounted within the shell interior parallel to one another, wherein some of the spheres of the shell-side interrupting structure contact the outer surface of more than one tube.

11. Shell and tube heat exchange apparatus as claimed in claim 8, wherein the tube-side fluid flow interruptor structure comprises a unitary body constituting the said plurality of longitudinally extending rows of spheroidal members protruding from the space-filling material.

12. Shell and tube heat exchange apparatus as claimed in claim 11, wherein the spheroidal elements are disposed in a helical configuration.

* * * * *